United States Patent [19]

Douglas et al.

[11] 4,098,724

[45] Jul. 4, 1978

[54] ELECTRICALLY CONDUCTIVE COMPOSITE MATERIALS

[75] Inventors: Peter Douglas, Weedon; Thomas Ian Stewart, Melbourn Near Royston, both of England

[73] Assignee: Plessey Handel und Investments A.G., Zug, Switzerland

[21] Appl. No.: 711,557

[22] Filed: Aug. 4, 1976

[30] Foreign Application Priority Data

Aug. 6, 1975 [GB] United Kingdom ..... 32801/75

[51] Int. Cl.[2] ..... H01B 1/02

[52] U.S. Cl. ..... 252/514; 75/173 A; 75/206; 75/211; 200/265; 200/266

[58] Field of Search ..... 252/514; 423/35, 42; 75/206, 211, 0.5 R, 0.5 A, 173 A; 200/265, 266

[56] References Cited

U.S. PATENT DOCUMENTS

| | | | |
|---|---|---|---|
| 3,472,654 | 10/1969 | Comey et al. | 75/173 A |
| 3,501,287 | 3/1970 | Lever | 75/206 X |

*Primary Examiner*—Benjamin H. Padgett
*Assistant Examiner*—E. Suzanne Parr
*Attorney, Agent, or Firm*—Fleit & Jacobson

[57] ABSTRACT

An electrically conductive composite material which consists of a mixture of silver, not more than 50 weight percent of cadmium oxide and not greater than 2,000 parts per million of compounds of potassium.

24 Claims, No Drawings

ELECTRICALLY CONDUCTIVE COMPOSITE MATERIALS

The invention relates to electrically conductive composite materials which have a particular but not necessarily an exclusive application in the fabrication of electrical contacts.

The invention provides an electrically conductive composite material which consists of a mixture of silver, not more than 50 weight percent of cadmium oxide and not greater than 2,000 parts per million of compounds of potassium.

According to a feature of the invention an electrically conductive composite material as outlined in the preceding paragraph is provided which consists of a mixture of silver, 8.44 weight percent of cadmium oxide and 240 parts per million of compounds of potassium.

The foregoing and other features according to the invention will be better understood from the following description of specific embodiments of the invention.

The electrically conductive composite materials according to the invention which are especially adapted for the fabrication of electrical contacts for use in medium to low duty applications consist of a mixture of silver, not more than 50 weight percent of cadmium oxide and not greater than 2,000 parts per million (p.p.m) of compounds of potassium.

The silver therefore provides the bulk of the composite materials and the materials should be produced such that the cadmium oxide and the compounds of potassium are spread uniformly throughout the silver.

The cadmium oxide effects weld embrittlement, i.e. contributes to the breaking of the welds which form when contact is established between electrical contacts fabricated from these silver based composite materials. Also, the cadmium vapour that will be present in the arc which occurs when contact between electrical contacts is broken, acts so as to reduce the mean electron energies in the arc and change the distribution of the electron energies in the arc to eliminate the high energy electrons.

The electrically conductive composite materials according to the invention are best fabricated by a method which involves co-precipitation, spray coprecipitation or powder metallurgical techniques.

With the co-precipitation and spray co-precipitation production methods, a mixture of silver and cadmium nitrates is reacted with potassium carbonate or potassium bicarbonate to produce silver and cadmium carbonates.

In addition to the compounds of potassium present in the composite material a certain amount of sodium will also be present as an impurity which results from the potassium carbonate and bicarbonate starting materials. The amount of the impurity will, in practice usually be not greater than 200 parts per million. When sodium is present in such amounts it performs a desirable function in that it acts in concert with the potassium in the elimination of high energy electrons produced during arc erosion. Therefore, the residual levels of the alkali metals present in the composite material are significant in that they provide a mechanism whereby the mean electron energies produced in the arcing process are reduced.

The silver and cadmium carbonates are then either (a) filtered and washed to give a required level of residual potassium, and then dried and fired to produce a powder containing silver, cadmium oxide and compounds of potassium of a desired composition, or (b) dried fired and washed in water in order to remove all the potassium salts and thereby provide substantially pure silver-cadmium oxide which can, for example, then be mixed with a solution of potassium nitrate in alcohol or water to give the required potassium level, the impregnated powder being dried and fired to produce a powder containing silver, cadmium oxide and compounds of potassium of a desired composition.

The level of the residual alkali metals present in the powder can be controlled by the washing and firing sequence because each washing and firing step acts so as to reduce the amount of residual alkali metals left in the composite material, and thereby acts as a control over the final amount of alkali metals remaining in the composite material. Thus, in the washing and firing sequence of method (a) above, a half washed powder is produced and in the washing and firing sequence of method (b) above, a fully washed powder is produced since additional washing and firing steps are undertaken.

Thus, in one example of the spray co-precipitation production method, for producing a half washed powder, the starting point is the formation of an intimately mixed nitrate solution from 157 grams of $AgNO_3$, 26.6. grams of $Cd(NO_3)_2 4H_2O$ and 200 ccs of distilled water, and the formation of a potassium carbonate solution using 192 grams per liter of $K_2CO_3$ in distilled water.

In the next step, 60 ccs of the mixed nitrates solution is sprayed into 600 ccs of the potassium carbonate solution at a gas pressure of about 2 pounds per square inch using about 5.0 liters per minute of a nitrogen carrier gas, the potassium carbonate solution being maintained at a temperature of about 20° C. The chemical reaction which occurs as a result of this step is as follows:

$$2AgNO_3 + K_2CO_3 \rightarrow Ag_2CO_3 + 2KNO_3$$

$$Cd(NO_3)_2 + K_2CO_3 \rightarrow CdCO_3 + 2KNO_3$$

The atomised droplets of the sprayed mixed nitrates solution may have a geometric mean size of about 20 microns and it is important to ensure that a large excess of carbonate is preset.

The precipitate of this chemical reaction which is canary yellow in colour, is then suction filtered and washed with 2 liters of distilled water.

The washed precipitate is then rewashed with 1.5 liters of distilled water, refiltered and then washed again with 1.5 liters of distilled water before being dried, for example, in a wind oven at a temperature of 80° C.

The dried powder is then sieved and finally fired by being heated in air at a temperature of about 500° C for a period of about $1\frac{1}{2}$ hours.

The composite powdered material which results from this method consists of 8.44 weight percent of cadmium oxide, 240 p.p.m. of compounds of potassium and the remainder silver.

In a preferred method a fully washed powder is produced by spray co-precipitation, by firstly forming an intimately mixed nitrate solution of 334.5 grams of $AgNO_3$, 90.4 grams of $Cd(NO_3)_2 4H_2O$ and distilled water is reacted, in the manner outlined in preceding paragraphs with a potassium bicarbonate solution containing 1390 grams of $KHCO_3$ and distilled water, the potassium bicarbonate solution being maintained at a temperature of about 20° C.

The precipitate of this chemical reaction is then suction filtered, washed with 20 liters of distilled water and then dried at a temperature of 80° C.

The dried powder is then sieved, fired by being heated in air at a temperature of about 500° C for a period of about 1 hour, washed with 2.5 liters of distilled water, dried at a temperature of 80° C, resieved and then finally fired in the specified manner at a temperature of about 500° C to provide a composite material containing 15 weight percent of cadmium oxide 20 p.p.m. of compounds of potassium, 20 p.p.m. of sodium and the remainder silver.

Utilizing the method of producing a fully washed powder by spray co-precipitation as outlined in the preceding paragraphs, a number of composite materials having different compositions were produced and then subjected to tests for arc erosion and weld embrittlement.

In one arc erosion test schedule, a composite material consisting of 15 weight percent of cadmium oxide 52 parts per million of compounds of potassium, 40 parts per million of compounds of sodium, and the remainder silver was subjected to a I.E.C. AC-4 Erosion Test. The conditions of this test were (a) a rate of operation of 300 arcs per hour on time for 120 milliseconds in 12 seconds; (b) a test current of 300 amps at a power factor of 0.35; and (c) a test voltage of 415V, 50Hz. Under these test condutions the composite material gave a mean erosion loss after 100,000 arcs of 2.1 gms per pole.

In testing for weld embrittlement, a composite material consisting of 15 weight percent of cadmium oxide, 28 parts per million of compounds of potassium, 26 parts per million of compounds of sodium and the remainder silver, was subjected to a standard ASTM Weld Test. The conditions of this test were such that a test voltage of 240vAC and a power factor of 50% was applied to contacts fabricated from the composite material, and the contacts were then subjected to arcing for 10 milliseconds to simulate contact 'bounce'. This process was then followed by contact closure at a current 150 amps. Under these conditions the composite material gave 64 welds out of 200 operations with a maximum weld strength of 6lbs.

With the production method which involves powder metallurgical techniques the starting point is the production of a silver-cadmium oxide alloy powder of a desired composition. This is effected by a process which includes the steps of mixing silver powder and cadmium oxide powder in a desired ratio to provide a powder mixture having a fine, evenly dispersed cadmium oxide content, heating the powder mixture in a reducing atmosphere to produce a silver-cadmium alloy in powder form and heating the silver-cadmium alloy powder to a temperature in the range 180° C to the melting point of the alloy, in an oxidising atmosphere to effect re-oxidation of the cadmium and thereby the production of internally oxidised silver-cadmium oxide alloy powder.

The silver-cadmium oxide alloy powder is then slurried with a solution of potassium nitrate in alcohol or water to give the required potassium level.

The slurry is then dried in air, sieved to a required degree of fineness and then finally fired at an elevated temperature to decompose the potassium nitrate.

The resulting powder mixture consists of an internally oxidised silver-cadmium oxide alloy powder with particles of compounds of potassium dispersed over the surface of the powder particles.

The particular compounds of potassium that are present in the electrically conductive composite materials according to the invention is dependent upon the manner in which the powder is cooled after the firing step. If the powdered material is cooled in carbon dioxide free air then the potassium will be present as potassium oxide and peroxide but if the cooling is effected in carbon dioxide only then the potassium will be present as potassium carbonate. If, however, the cooling is effected in free air then the potassium will be present as potassium oxide, peroxide, hydroxide and carbonate.

The powdered electrically conductive composite materials produced by the methods outlined in preceding paragraphs can then be formed into a desired shape, for example of the electrical contacts to be produced by firstly pressing the sieved powder at a pressure of 30 t.s.i., the pressing pressure being chosen such that the pressed composite material is of a high green strength and subject to a minimum amount of blistering and expanion on sintering.

Secondly the composite material is sintered for 1 hour in air at a temperature selected so as to produce a desired microstructure. The differences in microstructure ying in the diameter of the cadmium oxide particles and their distribution density. The diameter of the cadmium oxide particles increases with an increase in sintering temperature. In general materials that contain a low level of cadmium oxide i.e. 15% or less, increase in volume to some extent at all sintering temperatures with more expansion occurring at a temperature of 930° C than at a temperature of 850° C or at a temperature of 758° C.

The sintered material is then coined at a pressure of 54 t.s.i. the coined composite material is then utilized for electrical contacts having a desired shape.

It is to be understood that the foregoing description of specific examples of this invention is made by way of example only and is not to be considered as a limitation in its scope.

What is claimed is:

1. An electrically conductive composite material consisting of a mixture of silver; not more than 50 percent by weight of cadmium oxide and not greater than 2,000 parts per million of compounds of potassium, the source of origin of said potassium consisting of potassium compounds and not including elemental potassium.

2. An electrically conductive composite material as claimed in claim 1 wherein the composite material consists of a mixture of silver, not more than 50 weight percent of cadmium oxide, not greater than 2,000 parts per million of compounds of potassium, and not greater than 200 parts per million of compounds of sodium.

3. An electrically conductive composite material as claimed in claim 1 wherein the composite material consists of a mixture of silver, 8.44 weight percent of cadmium oxide, and 240 parts per million of compounds of potassium.

4. An electrically conductive composite material as claimed in claim 2 wherein the composite material consists of a mixture of silver, 15 weight percent of cadmium oxide, 20 parts per million of compounds of potassium and 20 parts per million of compounds of sodium.

5. An electrically conductive composite material as claimed in claim 2 wherein the composite material consists of a mixture of silver, 15 weight percent of cadmium oxide, 52 parts per million of compounds of potassium, and 40 parts per million of compounds of sodium.

6. An electrically conductive composite material as claimed in claim 2 wherein the composite material consists of a mixture of silver, 15 weight percent of cadmium oxide, 28 parts per million of compounds of potassium, and 26 parts per million of compounds of sodium.

7. A method of producing an electrically conductive composite material which includes the steps of forming an intimately dispersed mixed nitrate solution in water, said nitrate solution comprising $AgNO_3$ and $Cd(NO_3)_2$, forming an intimately dispersed $K_2CO_3$solution containing sodium as an alkali metal impurity, spraying the mixed nitrate solution in the form of atomized droplets contained in a carrier gas at low pressure into an excess of the potassium carbonate solution in order to effect a co-precipitation reaction; filtering the precipitate formed by the co-precipitation; washing the precipitate until a desired residual level of alkali metal remains in the precipitate; drying the washed precipitate; sieving the dried precipitate; and firing the sieved precipitate in a manner whereby a composite material having a desired residual level of alkali metals is produced.

8. A method of producing an electrically conductive composite material which includes the steps of forming an intimately dispersed mixed nitrate solution in water, said nitrate solution comprising $AgNO_3$ and $Cd(NO_3)_2$, forming an intimately dispersed potassium bicarbonate solution containing sodium as an alkali metal impurity; spraying the mixed nitrate solution in the form of atomized droplets contained in a carrier gas at low pressure into an excess of the potassium bicarbonate solution in order to effect a co-precipitation reaction; filtering the precipitate formed by the co-precipitation reaction; washing the said precipitate in water so as to effectively reduce the residual levels of said alkali metal present in the said precipitate; drying the said precipitate at an elevated temperature; sieving the dried precipitate so as to produce a powder of uniform particle size; firing the powder at an elevated temperature for a period of time in order to effectively reduce the residual levels of said alkali metal present in the powder; washing the powder in water so as to effectively reduce the residual levels of said alkali metal present in the powder; drying the powder at an elevated temperature; resieving the powder to produce a powder having a uniform particle size; and firing the said powder at elevated temperature so that the residual levels of said alkali metals present in the composite material are effectively controlled.

9. A method of producing an electrically conductive composite material which includes the steps of mixing silver powder and cadmium oxide powder in a desired ratio to provide a powder mixture having a fine, evenly dispersed cadmium oxide content; heating the powder mixture in a reducing atmosphere to produce a silver-cadmium alloy in alloy form; heating the silver-cadmium alloy powder in an oxidizing atmosphere to effect re-oxidation of the cadmium and thereby produce an internally oxidized silver-cadmium alloy powder; slurrying the silver-cadmium oxide alloy powder with a solution of potassium nitrate to give a desired alkali metal level; drying the slurry in air; sieving the dried slurry to produce a powder having a fine, uniformly divided particle structure; and firing the powder at an elevated temperature to produce an internally oxidized silver-cadmium alloy powder with particles of compounds of alkali metal dispersed over the surface of the powder particles.

10. A method of producing an electrically conductive composite material as claimed in claim 7 wherein the mixed nitrate solution consists of a mixture of 157 grams of $AgNO_3$, 26.6 grams of $Cd(NO_3)_2 4H_2O$ and 200 ccs of distilled water.

11. A method of producing an electrically conductive composite material as claimed in claim 7 wherein the potassium carbonate solution consists of 192 grams per liter of potassium carbonate dissolved in distilled water.

12. A method of producing an electrically conductive composite material as claimed in claim 7 wherein the potassium carbonate solution is maintained at a temperature of 20° C.

13. A method of producing an electrically conductive composite material as claimed in claim 7 wherein 60 ccs of the said mixed nitrate solution are sprayed into 600 ccs of the potassium carbonate solution at a gas pressure of 2 pounds per square inch using 5.0 liters per minute of carrier gas.

14. A method of producing an electrically conductive composite material as claimed in claim 13 wherein the carrier gas is nitrogen.

15. A method of producing an electrically conductive composite material as claimed in claim 8 wherein the drying steps are effected at 80° C.

16. A method of producing an electrically conductive composite material as claimed in claim 8 wherein the firing steps are effected at a temperature of no less than 500° C for a period of not less than 1 hour.

17. A method of producing an electrically conductive material as claimed in claim 8 wherein the mixed nitrate solution consists of 334.5 grams $AgNO_3$; 90.4 grams of $Cd(NO_3)_2 4H_2O$ in distilled water.

18. A method of producing an electrically conductive composite material as claimed in claim 8 wherein the potassium bicarbonate solution consists of 1390 grams of potassium bicarbonate dissolved in distilled water.

19. A method of producing an electrically conductive composite material as claimed in claim 8 wherein the potassium bicarbonate solution is maintained at a temperature of 20° C.

20. A method of producing an electrically conductive composite material as claimed in claim 8 wherein 60 ccs of the said mixed nitrate solution are sprayed into 600 ccs of the said potassium bicarbonate solution at a gas pressure of 2 pounds per square inch using 5.0 liters per minute of carrier gas.

21. A method of producing an electrically conductive composite material as claimed in claim 20 wherein the carrier gas is nitrogen.

22. A method of producing an electrically conductive composite material as claimed in claim 7 wherein the drying step is effected at a temperature of 80° C.

23. A method of producing an electrically conductive composite material as claimed in claim 7 wherein the firing step is effected at a temperature of no less than 500° C for a period of not less than 1 hour.

24. A method of producing an electrically conductive composite material as claimed in claim 10 wherein the production of an internally oxidized silver-cadmium alloy powder is effected at a temperature in the range of 180° C to the melting point of the alloy.

* * * * *